US009188324B2

(12) United States Patent
Jelinek et al.

(10) Patent No.: US 9,188,324 B2
(45) Date of Patent: Nov. 17, 2015

(54) MODULAR LED LIGHT

(71) Applicant: Hella KGaA Hueck & Co., Lippstadt (DE)

(72) Inventors: Mark Jelinek, Lippstadt (DE); Gerd Mertens, Geseke (DE); Reinhold Brummel, Anröchte (DE)

(73) Assignee: HELLA KGAA HUECK & CO., Lippstadt (DE)

( * ) Notice: Subject to any disclaimer, the term of this patent is extended or adjusted under 35 U.S.C. 154(b) by 0 days.

(21) Appl. No.: 14/512,836

(22) Filed: Oct. 13, 2014

(65) Prior Publication Data

US 2015/0029731 A1 Jan. 29, 2015

Related U.S. Application Data

(63) Continuation of application No. PCT/EP2013/057734, filed on Apr. 12, 2013.

(30) Foreign Application Priority Data

Apr. 13, 2012 (EP) ..... 12164193

(51) Int. Cl.
*F21V 23/06* (2006.01)
*F21V 15/01* (2006.01)
(Continued)

(52) U.S. Cl.
CPC ..... *F21V 31/005* (2013.01); *F21K 9/00* (2013.01); *F21K 9/30* (2013.01); *F21V 3/00* (2013.01);
(Continued)

(58) Field of Classification Search
CPC ... F21V 23/002; F21V 23/007; F21V 23/008; F21V 23/009; F21V 23/06; F21V 15/01; F21V 31/005; F21V 3/00; F21V 19/0035; F21V 19/005; F21K 9/00; F21Y 2101/02; H01R 25/14; H01R 25/142; H01R 25/006; H01R 25/16; H01R 25/162; H01R 25/164; H01R 29/00
USPC ..... 439/110, 207, 211
See application file for complete search history.

(56) References Cited

U.S. PATENT DOCUMENTS 3,551,669 A 12/1970 Muller ..... 240/73
7,429,186 B2 9/2008 Mrakovich et al. ..... 439/404
(Continued)

FOREIGN PATENT DOCUMENTS

DE 102 41 941 3/2004
DE 10 2010 042 264 4/2012
(Continued)

OTHER PUBLICATIONS

Trilux 769 . . . (IP 20) E-line Mounting instructions (allegedly created Aug. 21, 2007 and published in 2007).
(Continued)

*Primary Examiner* — Alan Cariaso
(74) *Attorney, Agent, or Firm* — Norton Rose Fulbright US LLP

(57) ABSTRACT

A light comprising at least a housing for a light module and a controller being electrically connected to a cable and to the light module may be mounted very easily if the housing comprises a cable duct for housing the at least one cable, wherein the cable duct comprises at least a first electrical connector being attached to the cable duct and if the controller comprises at least a second electrical connector and a third electrical connector, wherein the second electrical connector is complementary to the first electrical connector, and if the cable duct and/or the controller comprise a first support structure for attaching the cable duct with the controller, wherein the first support structure attaches the cable duct with the controller, when the first electrical connector and the second electrical connector get plugged.

26 Claims, 5 Drawing Sheets

(51) Int. Cl.

| | |
|---|---|
| ***F21V 31/00*** | (2006.01) |
| ***F21V 3/00*** | (2015.01) |
| ***F21K 99/00*** | (2010.01) |
| ***F21V 19/00*** | (2006.01) |
| ***F21V 23/00*** | (2015.01) |
| *F21Y 101/02* | (2006.01) |

(52) U.S. Cl.

CPC ..... *F21V 15/01* (2013.01); *F21V 19/005* (2013.01); *F21V 23/002* (2013.01); *F21V 23/009* (2013.01); *F21V 23/06* (2013.01); *F21Y 2101/02* (2013.01)

(56) References Cited

U.S. PATENT DOCUMENTS

| | | | | |
|---|---|---|---|---|
| 8,220,976 | B2 * | 7/2012 | Liu et al. | 362/373 |
| 8,851,703 | B2 * | 10/2014 | Blackstone | 362/221 |
| 2002/0137374 | A1 | 9/2002 | O'Rourke et al. | 439/121 |
| 2004/0184264 | A1 | 9/2004 | Elam et al. | 362/148 |
| 2006/0262545 | A1 | 11/2006 | Piepgras et al. | 362/373 |
| 2009/0026835 | A1 | 1/2009 | Matsubara et al. | 303/15 |
| 2009/0268435 | A1 | 10/2009 | Mandy et al. | 362/147 |

FOREIGN PATENT DOCUMENTS

| | | |
|---|---|---|
| EP | 1 182 396 | 2/2002 |
| EP | 1 293 724 | 3/2003 |
| EP | 2 086 065 | 8/2009 |
| EP | 2 088 368 | 8/2009 |
| EP | 2 151 899 | 2/2010 |
| JP | 2008-258066 | 10/2008 |
| JP | 2012-181944 | 9/2012 |
| WO | WO/01/91249 | 11/2001 |
| WO | WO/2006/127666 | 11/2006 |
| WO | WO/2011/122518 | 10/2011 |
| WO | WO/2011/144689 | 11/2011 |

OTHER PUBLICATIONS

Trilux 768 . . . , 769 . . . Mounting instructions (allegedly created May 26, 2003 and published in 2003).

Trilux 7691N/58 LED-Tube, 7692/58 LED-Tube Mounting instructions (allegedly created Jul. 7, 2011 and published in 2011).

Communication of a notice of opposition in European Application No. 12164193.0 dated May 6, 2015.

Extended European Search Report in European Application No. 12164193.0 mailed Sep. 19, 2012.

International Search Report in International Application No. PCT/EP2013/057734 mailed Jun. 24, 2013.

Communication pursuant to Article 94(3) EPC in European Application No. 12164193.0 mailed Jul. 31, 2013.

Communication under Rule 71(3) EPC in European Application No. 12164193.0 mailed Jan. 29, 2014.

Decision to grant a European patent pursuant to Article 97(1) EPC in European Application No. 12164193.0 mailed Jun. 26, 2014.

* cited by examiner

MODULAR LED LIGHT

PRIORITY CLAIM

This application is a continuation of pending International Patent Application No. PCT/EP2013/057734 filed on 12 Apr. 2013, which designates the United States and claims priority from European Patent Application No. 12164193.0 filed on 13 Apr. 2012, both of which are incorporated by reference in their entireties.

BACKGROUND OF THE INVENTION

1. Field of the Invention

The invention relates to a modular LED-light comprising a housing for a controller and a light module.

2. Description of Relevant Art

US 2006/0262545 discloses a modular LED light. The LED light has a housing with a compartment for insertion of a controller. The controller is connected by wirings to a power line and to a data bus, e.g. Ethernet via RJ45 jacks. The controller is connected to a LED module by an output wiring. The output wiring may end in a socket for a connector of a LED module. The socket is attached to a base, the latter being supported by the housing. For mounting the LED light, the housing is inserted into an aperture in a ceiling and fixed to the ceiling. Subsequently the wiring is connected to the power line, a control input wire and inserted via an opening of the housing into the compartment. When the controller reaches its final position, it is attached to the housing by a clamping element.

US 2009/268435 A1 discloses a downward illumination assembly, i.e. a light. The light has a housing which removably supports a power supply module in a receptacle tray with side panels. The receptacle tray is fixed to the housing by threaded post integrally extending from tray mounting tabs. The power supply module has two mounting tabs each with a slot for receiving one of said threaded posts. Wing nuts thread on the respective posts and thereby clamp the module mounting tabs to the housing wall.

US 2004/0184264 A1 discloses a light with a support module, supports to hang down from the support module and to suspend a light fixture body module.

SUMMARY OF THE INVENTION

The invention is based on the observation that LED-lights for wall or ceilings often have a modular design. However, they are complicated to mount and in most cases mounting requires a certified electrician for connecting the wires.

The problem to be solved by the invention is to provide an easy to mount modular LED-light that is in particular suited for being arranged in a row with other lights, to form a "light strip", i.e., a row of lights.

In an embodiment, the light comprises at least housing for a light module and a controller. The controller preferably has a casing and is electrically connected to a cable, e.g. a power line and/or a data transmission cable, and to the light module. The housing preferably comprises a cable duct for housing the at least one power line. The cable duct may comprise at least a first electrical connector being attached to the cable duct. The controller may comprise at least a second electrical connector and preferably as well third electrical connector. The second electrical connector is complementary to the first electrical connector. The cable duct and/or the controller preferably comprise a first support structure for attaching the cable duct with the controller. The first support structure attaches the cable duct to the controller when the first electrical connector and the second electrical connector reach their final plugged position. This enables to electrically connect and to mechanically attach the controller and the cable duct simultaneously. By plugging the first and second electrical connectors the controller is electrically connected to the cable. The support structure mechanically attaches the controller to the cable duct and thus to the housing.

In an embodiment, the second electrical connector can be plugged into the first electrical connector from the outside of the cable duct, i.e., the first electrical connector can be accessed without opening the cable duct. Thereby, the cable, e.g. a power line, and the "user interface side" of the first electrical connector are separated.

In a further embodiment, the light may further comprise a controller with at least a casing, a second electrical connector and a third electrical connector, wherein the second electrical connector is complementary to the first electrical connector and wherein the second electrical connector and the third electrical connector are preferably each pluggable from the outside of the cable duct. This enables to directly connect the first and second electrical connectors. At least one of the second and third electrical connectors is preferably fixed to a casing of the controller. The second and third electrical connectors, respectively, may be integrated in the casing. Their pins or female counterparts, respectively, may be mounted directly to a circuit board of the controller. The light module may comprise a fourth electrical connector. If the latter is complementary to the third electrical connector and pluggable from the outside of the casing, the light module can be connected to the controller by simply plugging the third and fourth electrical connector. The electrical connection between the controller and the light module is provided by mating, i.e. plugging the third and fourth connectors.

In an example embodiment, the cable duct or the controller or both comprise a first support structure for attaching the cable duct with the controller, wherein the first support structure attaches the cable duct with the controller, when the first electrical connector and the second electrical connector reach their final positions. Thus, when the first and second electrical connectors are plugged, the controller is automatically attached to the cable duct. The first support structure may be integrated in the first and/or second electrical connectors. Alternatively the first support structure is separate, but preferably the cable duct and the controller are attached to each other at the same time the first and second electrical connectors are connected to each other. The first support structure may interlock the connection of the first and second electrical connectors.

Preferably, at least one of the light module and the controller comprises a second support structure for attaching the light module with the controller, wherein the second support structure mechanically attaches the light module with the controller, when the third electrical connector and the fourth electrical connector reach their final plugged positions. This enables to simply and safely attach and connect the light module to the cable duct or the controller or both, respectively.

In an embodiment, the first support structure or the second support structure (or both of them) may be integrated at least in part in at least one of the first electrical connector and the second electrical connector and in the third electrical connector and the fourth electrical connector, respectively.

The extension of the cable duct defines a longitudinal direction and transversal direction. Preferably the second electrical connector and the third electrical connector are displaced against each other in the longitudinal direction or the transversal direction or both directions. This enables to design a controller with a reduced height. A controller may be connected to and/or attached with two or more light modules. Accordingly the controller may have two or more third electrical connectors.

In a preferred embodiment, the cable duct comprises at least a profile, with at least a base segment and two legs extending from the base segment, wherein the base segment and the two legs form a compartment for at least the controller or the light module (or both). The controller may be inserted easily into the compartment, the first and second electrical connectors may be connected simultaneously and the support structure may attach the cable duct with the controller simultaneously. Thus, mounting of the controller is extremely easy, as it is sufficient to insert it into the compartment. The two legs are preferably part of the support structure and may be configured as guides for the controller, guiding it to its final attached position when inserting the controller into the compartment. For example, the cable duct may comprise a profile with an H-type cross section. The horizontal bar of the H-type profile forms the base segment. The two downwardly extending legs may form said legs. These legs may define the compartment for the controller. The two upwardly extending legs may form a cable duct for housing, e.g., a power line or other cables. A cover may close the cable duct.

For example, the two legs Peach have at least a first attachment member and the controller may have at least a second attachment member. The first and second attachment members may engage when the controller reaches its final position in the compartment and thereby attach the cable duct with the controller.

The light module may cover the compartment for the controller, when plugged to the controller. Thus, the light appears to be fully integrated in the cable duct.

Preferably the light module has at least an interlocking member, wherein the interlocking member blocks at least one of the first or second attachment members from releasing the engagement. For example may the interlocking member be a protrusion engaging in a recess of the controller, thereby blocking at least one of the first or second attachment members from being pivoted out of the engagement with the respective second and/or first attachment member.

For example, the light module may comprise a base with at least a light exit window. The base may comprise at least one recess defining the light exit window, and at least one rest defining the position of at least one printed circuit board relative to the light exit window. The printed circuit board preferably covers the recess. The printed circuit board and the cover may be attached to each other by a connection frame. This kind of attachment reduces strain on the printed circuit board and the base due to heat of operating LEDs or other light sources. The light module comprises at least one light source, e.g., one or more LEDs. The light sources are preferably in a box like section being confined by the base and the printed circuit board.

BRIEF DESCRIPTION OF THE DRAWINGS

In the following, the invention will be described by way of example, without limitation of the general inventive concept, on examples of embodiment and with reference to the drawings.

Figure 1:
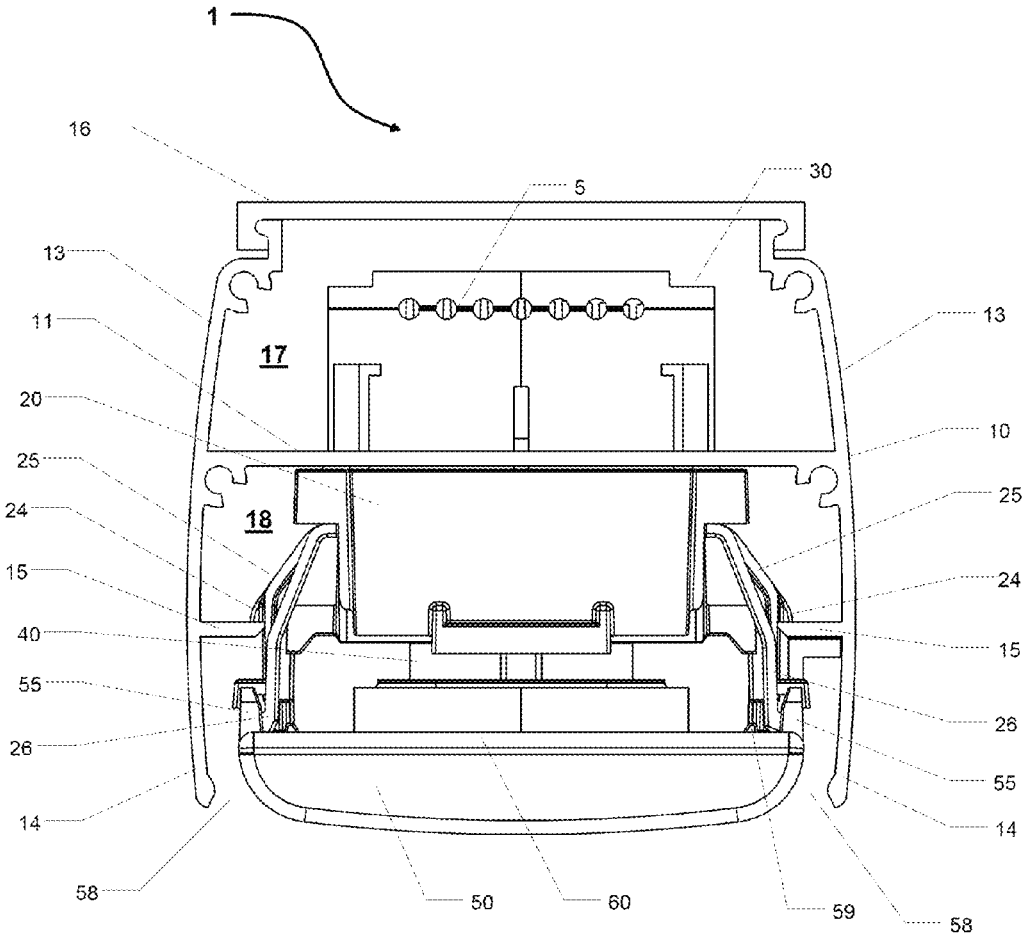
FIG. 1 shows sectional view of a light.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

FIG. 1 shows a sectional view of a light 1 with a housing, comprising a profile 10 having an H-type cross section. Thus, the profile has a base leg 11, and two pairs of free legs 13, 14 extending from the base leg 11. The legs 13 and the base leg 11 provide a cable duct 17 that may be closed by a cover 16. The space between the legs 11, 14 forms a compartment 18 for a controller 20 and a lighting module 50.

In the cable duct 17 is a cable 5 for providing the controller with power and preferably as well with data via some data line. The cable 5 is connected to a first electrical connector 30, extending through the base leg 11. The first electrical connector 30 is connected with a second electrical connector 35, which is hidden in FIG. 1 (cf. FIG. 2). The second electrical connector 35 is integrated in the casing of the controller 20. The casing has an upper and a lower half shell 21, 22. Between the half shells 21, 22 are electronic components (not shown). The controller 20 is positioned in the compartment 18 and attached to the profile 10 by flexible levers 25 of first support structures. The levers 25 engage with rim like protrusions 15 extending from the legs 14 into the compartment 18, as will be explained in more detail below. Attached to the controller 20 is a light module 50.

Figure 2:
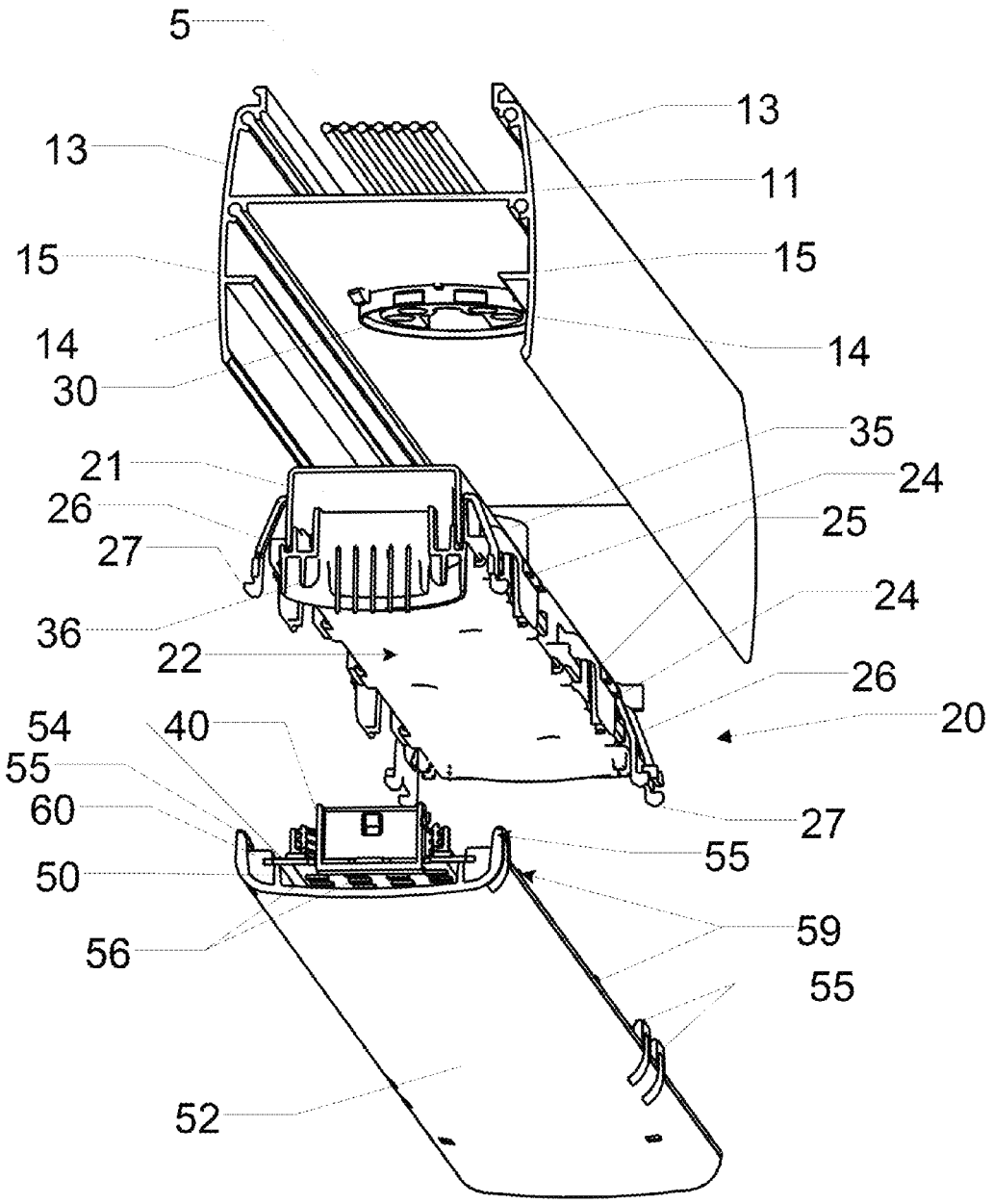
FIG. 2 shows an exploded isometric sectional view of a light.

FIG. 2 shows an exploded isometric sectional view of the light of FIG. 1. As can be seen in FIG. 2, the controller 20 has a third electrical connector 36 mating with fourth electrical connector 40 of the light module 50. The light module 50 and the controller 20 may be attached to each other by second support structures. The second support structures have latches 26, extending from the casing of the controller. At the distal ends of the latches 26 are catches 27, which may engage into recess members 55 of the light module 50 and thereby attach the light module 50 to the controller 20.

The light module 50 comprises a transmissive base 51. The base 51 has at least one recess 57 defining a light exit window 52 and at least one rest 52 for a printed circuit board 54. The rest 52 defines the position of the printed circuit 54 board relative to the light exit window 52. The printed circuit board 54 may cover the recess 57 and support light sources like LEDs 56. The printed circuit board 54 and the base 51 may be attached to each other by a connection frame 60.

The light module 50, in particular the base 51 of the light module, may have protrusions 59 as interlocking members 59. Each interlocking member 59 may block the levers 25 of the first support structure. This means, attaching the light module 50 to the controller interlocks the controller with the cable duct 17.

Figure 3:
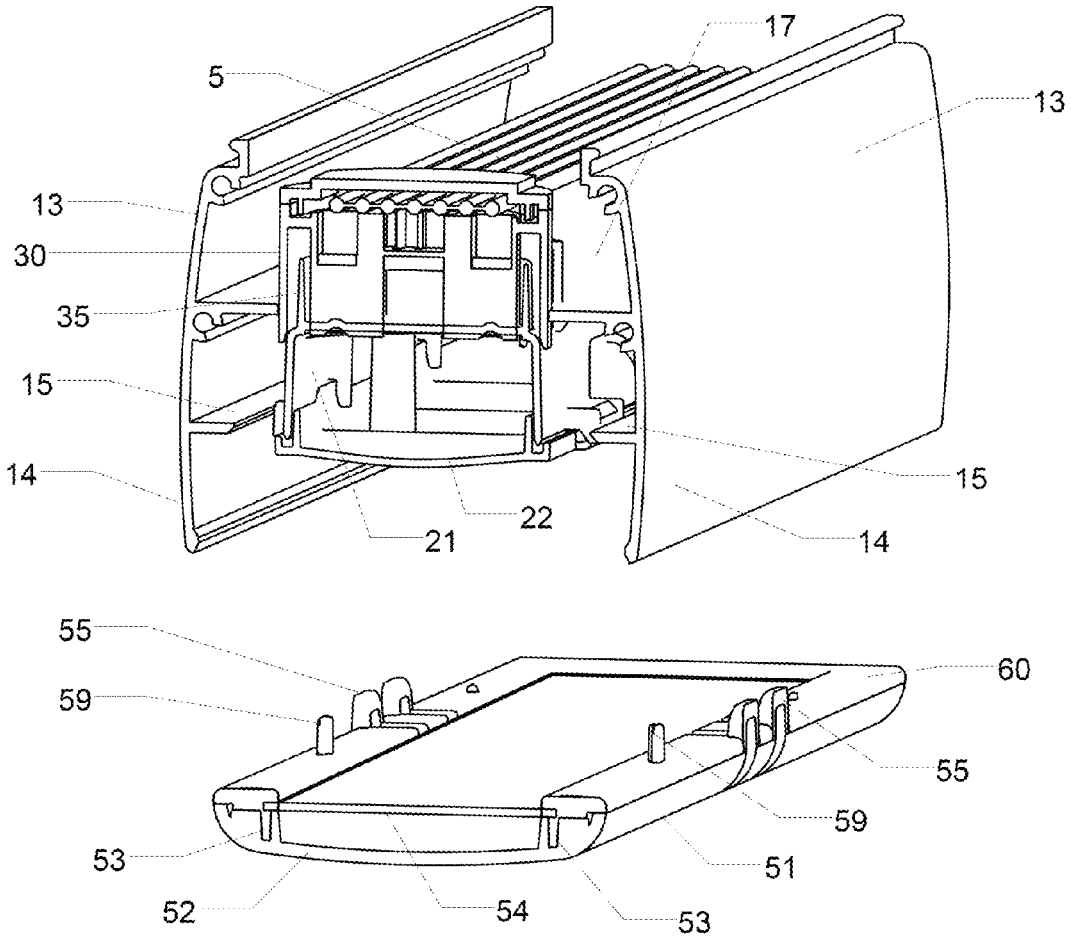
FIG. 3 shows a sectional view of a partially mounted light.

FIG. 3 shows a partially mounted, section of the light. The controller 20 is already attached with the profile 10 of the cable duct 17. The second electrical connector 35 engages with the first electrical connector 30 and the first support structure (hidden, cf. FIG. 2) attaches the controller and the cable duct 17. The light module 50 is prepared for being attached and simultaneously connected to the controller 20.

Depicted is a printed circuit board 54, covering the recess just above the light exit window 52 of the base 51. As can be best seen in FIG. 3, the base 51 has protrusion like interlocking members 59 and recess members 55, the latter being part of the second support structure. The third electrical connector 36 and the fourth electrical connector 40 cannot be seen in FIG. 3, as they are longitudinally displaced relative to the first and second electrical connectors, as can be seen in FIG. 4.

Figure 4:
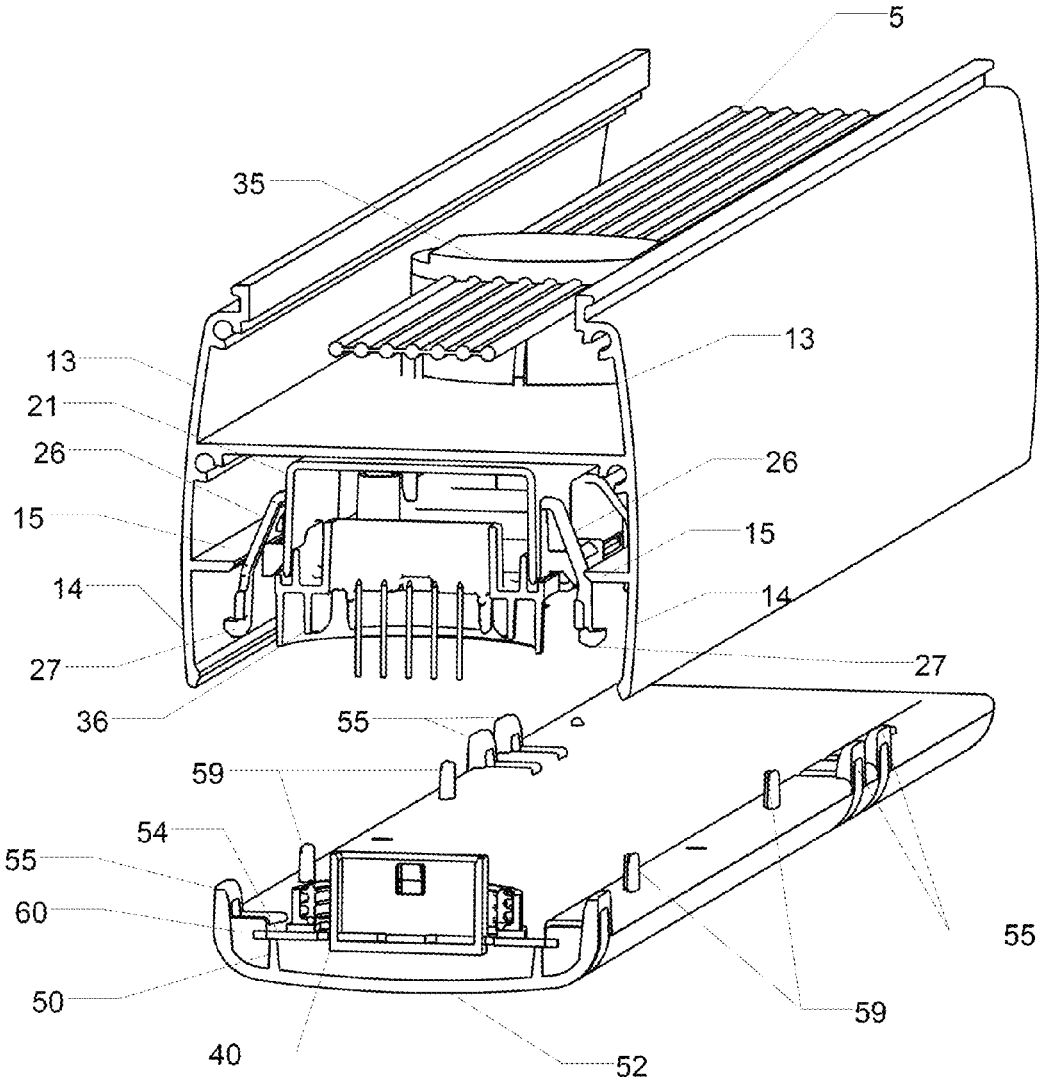
FIG. 4 shows a sectional view of a partially mounted light.

FIG. 4 shows a further section of partially mounted light 1 after attachment of the controller 20. The light module 50 is prepared for attachment to the controller 20. As can be seen, the light module has a base 51 with a recess defining a light exit window 52. At least the narrow sides of the recess form a step which is a rest 53 for the printed circuit board 54. The printed circuit board 54 may have a metal layer for dissipating heat produced by the light sources. As depicted, the printed circuit board may have a through hole, through which a fourth electrical connector 40 extends. Preferably, the fourth electrical connector is electrically connected with the printed circuit board at its exit window facing side. The fourth electrical connector 40 is positioned just opposite of the third electrical connector 36, for mating it simultaneously with attaching the light module 50 to the controller 20. For attaching the light module 50 with the controller, the light 1 has second support structures. The second support structures comprise latches 26, each having at their distal ends a catch 27 for engaging with complementary recess members 55. The recess members 55 are in the shown example protrusions extending from the light module 50, each having two recesses each for engagement of a catch 27.

Figure 5:
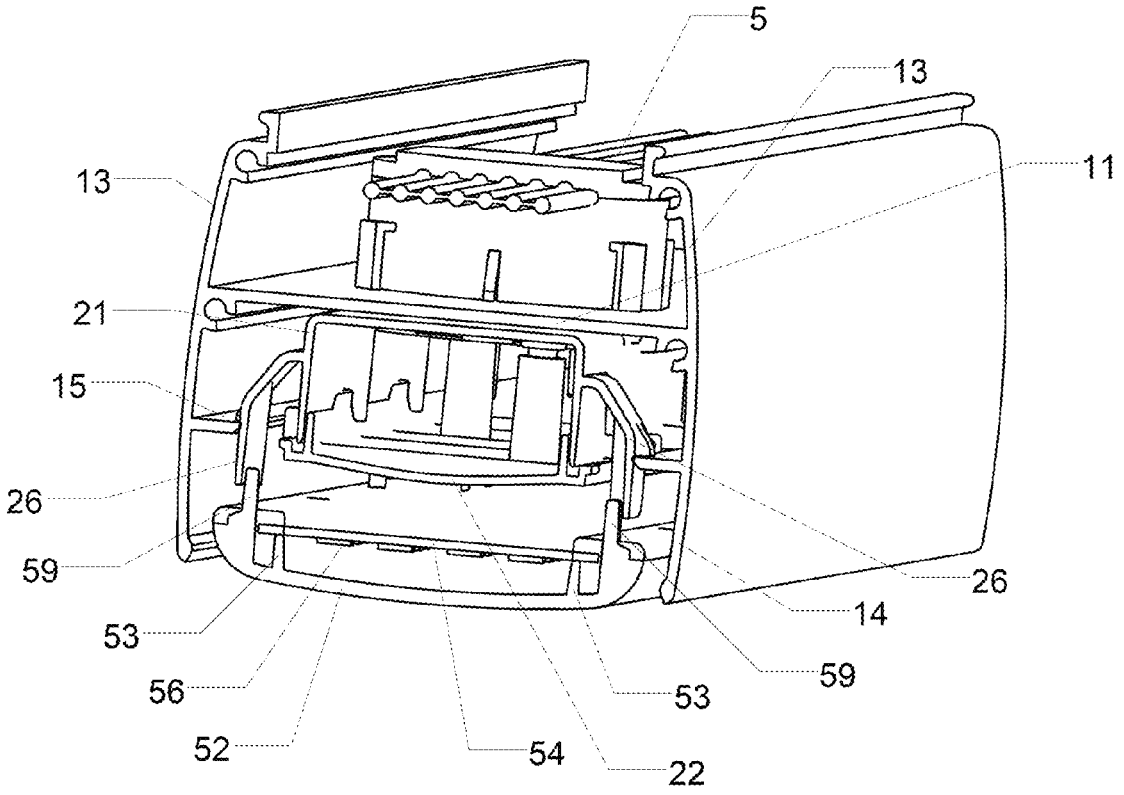
FIG. 5 shows a sectional view of a light.

FIG. 5 shows detail of a section of the light after attachment of the light module 50 to the controller 20. The light module closes the compartment 18, however, between the light module and the legs 14 remains a small ventilation gap. The light module 50 and the controller 20 are thus vented and thereby cooled. As already explained above, the first support structure attaches the controller to the cable duct 17, in particular to the legs 14 of the profile 10. As can be seen here the first support structure comprises levers 25, which are flexibly connected to the controller 20, in the depicted example to the upper half 21 of the casing of the controller 20. The levers 25 each have a nose 24 facing away from the casing. When inserting the controller 20 into the compartment 18, the protrusions 15 of the legs 14 slide over the bridge of the nose 24 thereby pivoting the lever 25 towards the controller 20 until it reaches its final position, i.e., the depicted position. Now the levers 25 pivot towards the legs 14 and the lower side of the nose 24 engages with the protrusion 15. Subsequently the light module is attached to the controller 20. The light module has interlocking members 59, each being positioned as a block at the controller 20 facing side of the levers 25, thereby preventing the levers 25 from pivoting and thus preventing the noses 24 from releasing the protrusion 15, which would release the attachment of the controller 20 to the cable duct 17.

When attaching the light module 50 to the controller 20, the third and fourth electrical connectors get mated. At the same time the catches 27 slide over the respective recess members 55 thereby pivoting the latches 26 until each of the catches 27 enters the recess of the respective recess member 55. Now the third and fourth electrical connectors 36, 40 are connected and the light module 50 is attached to the controller. The light is completely assembled. No tools or specific skills, like those of certified electrician are necessary. For mounting the light, one simply has to "click" the controller to the cable duct 17 and the light module to the controller. In case of failure of the light module 50 or the controller 20, the respective support structures can be released one after the other and the components can be replaced easily. For releasing the light module 50 the latches 27 are pivoted for releasing the engagement of the catches 27 with the recess members 55. Subsequently the light module can be pulled away from the controller 20, thereby decoupling the third and fourth electrical connectors 36, 40. The path, required to pull the light module away from the controller to decouple the third and fourth electrical connectors 36, 40 is preferably shorter than the section of the interlocking members 59 that engage with the first support structures. Thereby, it can be ensured that the interlocking of the first support structure, i.e., of the attachment of the cable duct 17 and controller 20 cannot be released until unmounting of the light module 50 is accomplished.

Mounting of the light can be further simplified, if the cable 5 has electrical connectors at both of its ends, permitting to form rows of lights, by simply aligning the profiles 10 to form a common cable duct 17 and to connect the cables 5 accordingly. Subsequently the controllers 20 and the light modules 50 can be attached as described above.

It is to be understood, that the controller may comprise a power supply for the light sources. The cable may be a one-phase or multi-phase AC power line or carry a DC signal not suited to directly drive the at least one light source, e.g. one or multiple LEDs. The controller may convert the power provided by the cable into a power signal for the at least one light source.

The controller may as well monitor variables like temperatures of the light sources and/or the printed circuit board, power on time of the light sources light intensity or the like and control the power provided to the light sources a function of at least one of the variables. Preferably the controller 20 is connected by some data bus to a main controller. The data bus enables the main controller to exchange data, e.g. values of the above listed variables with the controller and/or to send instructions like "power on light at xx %", "power off light".

It will be appreciated to those skilled in the art having the benefit of this disclosure that this invention is believed to provide an easy to mount modular LED-light that is in particular suited for being arranged in a row with other lights. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

1 light
5 cable/ribbon cable/power line
10 profile
11 base leg
13 free leg
14 free leg
15 protrusion of first support structure
16 cable duct cover
17 cable duct

18 compartment
20 controller
21 upper half shell of casing
22 lower half shell of casing
24 nose
25 lever
26 latch
27 catch
30 first electrical connector
35 second electrical connector
36 third electrical connector
40 fourth electrical connector
50 light module
51 base/lamp cover
52 light exit window/recess
53 rest
54 printed circuit board
55 recess member of second support structure
56 LED/light source
58 gap
59 interlocking member/protrusion
60 connection frame

The invention claimed is:

1. A light comprising:

a housing that houses a light module and a controller with a casing, the controller being electrically connected to a cable and to the light module, wherein:

the housing comprises a cable duct configured to house the at least one cable;

the housing comprises or is attached to at least a first connector at least partially disposed in the cable duct and connected with the at least one cable;

the controller comprises at least a second connector and a third connector, wherein the second connector is complementary to the first connector;

at least one of the housing and the controller comprises a first support structure for attaching the housing with the controller; and the first support structure attaches the housing to the controller when the first connector and the second connector are plugged together;

wherein the light module comprises at least a fourth connector, at least one of the light module and the controller comprises a second support structure configured to attach the light module with the controller, and the second support structure attaches the light module with the controller when the third connector and the fourth connector are plugged together.

2. The light of claim 1, wherein at least one of the first support structure and the second support structure are integrated at least in part in the first connector and the second connector, in the third connector and the fourth connector, or in all four of said first to fourth connectors.

3. The light of one claim 1, wherein the cable duct extends in a longitudinal direction, a transverse direction extends across a width of the cable duct, and the second connector and third connector are spaced apart in at least one of the longitudinal direction and the transversal direction.

4. The light of claim 1, wherein the housing has a profile with a base leg and a pair of legs extending from the base leg such that the base leg and the pair of legs form a compartment for at least one of the controller and the light module.

5. The light of claim 4, wherein the light module covers the compartment.

6. A light comprising:

a housing that houses a light module and a controller with a casing, the controller being electrically connected to a cable and to the light module, wherein:

the housing comprises a cable duct configured to house the at least one cable;

the housing comprises or is attached to at least a first connector at least partially disposed in the cable duct and connected with the at least one cable;

the controller comprises at least a second connector and a third connector, wherein the second connector is complementary to the first connector;

at least one of the housing and the controller comprises a first support structure for attaching the housing with the controller; and the first support structure attaches the housing to the controller when the first connector and the second connector are plugged together;

wherein the housing has a profile with a base leg and a pair of legs extending from the base leg such that the base leg and the pair of legs form a compartment for at least one of the controller and the light module;

wherein the legs each have at least a first attachment member, the controller has at least a second attachment member, and the first and second attachment members engage and thereby attach the cable duct with the controller.

7. The light of one claim 6, wherein the light module has at least one interlocking member that blocks at least one of the first or second attachment members from releasing the engagement between the first and second attachment members.

8. The light of one of claim 6 wherein at least one of the second and third connectors is fixed to the casing of the controller.

9. The light of claim 6 wherein:

the light module comprises a base, the base having a recess defining a light exit window;

the light module further comprises at least one rest defining the position of a printed circuit board relative to the light exit window;

the printed circuit board spans the recess; and the printed circuit board and the base are attached to each other.

10. A kit for forming a light, comprising:

a housing configured to house a light module and a controller, the housing comprising at least a cable duct for housing at least one cable, wherein the housing comprises or is attached to at least a first connector at least partially disposed in the cable duct, the first connector configured to be connected to the at least one cable;

the controller comprising at least a second connector and a third connector, wherein the second connector is for mating the first connector to electrically connect the controller to the at least one cable; and the light module configured to be electrically connected to the controller;

wherein at least one of the cable duct and the controller comprise a first support structure configured to attach the housing with the controller; and wherein the first support structure is configured to attach the housing to the controller when the first connector and the second connector are plugged together;

wherein the light module comprises at least a fourth connector, at least one of the light module and the controller comprises a second support structure configured to attach the light module with the controller, and the second support structure attaches the light module with the controller when the third connector and the fourth connector are plugged together.

11. The kit of claim 10, wherein at least one of the first support structure and the second support structure are integrated at least in part in the first connector and the second connector, in the third connector and the fourth connector, or in all four of said first to fourth connectors.

12. The kit of claim 10, wherein the cable duct extends in a longitudinal direction, a transverse direction extends across a width of the cable duct, and the second connector and third connector are spaced apart in at least one of the longitudinal direction and the transversal direction.

13. The kit of claim 10, wherein the housing has a profile with a base leg and a pair of legs extending from the base leg such that the base leg and the pair of legs form a compartment for at least one of the controller and the light module.

14. The kit of claim 13, wherein the light module covers the compartment.

15. The kit of claim 13, wherein the legs each have at least a first attachment member, the controller has at least a second attachment member, and the first and second attachment members engage and thereby attach the cable duct with the controller.

16. The kit of claim 15, wherein the light module has at least one interlocking member that blocks at least one of the first or second attachment members from releasing the engagement between the first and second attachment members.

17. The kit of claim 10 wherein at least one of the second and third connectors is fixed to the casing of the controller.

18. The kit of claim 10 wherein:

the light module comprises a base, the base having a recess defining a light exit window;

the light module further comprises at least one rest defining the position of a printed circuit board relative to the light exit window;

the printed circuit board spans the recess; and the printed circuit board and the base are attached to each other.

19. A kit for forming a light, comprising:

a housing configured to house a light module and a controller, the housing comprising at least a cable duct for housing at least one cable, wherein the housing comprises or is attached to at least a first connector at least partially disposed in the cable duct, the first connector configured to be connected to the at least one cable;

the controller comprising at least a second connector for mating the first connector to electrically connect the controller to the at least one cable; and the light module configured to be electrically connected to the controller;

wherein at least one of the cable duct and the controller comprise a first support structure configured to attach the housing with the controller;

wherein the first support structure is configured to attach the housing to the controller when the first connector and the second connector are plugged together;

wherein the housing has a profile with a base leg and a pair of legs extending from the base leg such that the base leg and the pair of legs form a compartment for at least one of the controller and the light module; and wherein the legs each have at least a first attachment member, the controller has at least a second attachment member, and the first and second attachment members engage and thereby attach the cable duct with the controller.

20. The kit of claim 19, wherein the controller further comprises a third connector, the light module comprises at least a fourth connector, at least one of the light module and the controller comprises a second support structure configured to attach the light module with the controller, and the second support structure attaches the light module with the controller when the third connector and the fourth connector are plugged together.

21. The kit of claim 20, wherein at least one of the first support structure and the second support structure are integrated at least in part in the first connector and the second connector, in the third connector and the fourth connector, or in all four of said first to fourth connectors.

22. The kit of claim 19, wherein the cable duct extends in a longitudinal direction, a transverse direction extends across a width of the cable duct, and the second connector and third connector are spaced apart in at least one of the longitudinal direction and the transversal direction.

23. The kit of claim 22, wherein the light module covers the compartment.

24. The kit of claim 23, wherein the light module has at least one interlocking member that blocks at least one of the first or second attachment members from releasing the engagement between the first and second attachment members.

25. The kit of of claim 19, wherein at least one of the second and third connectors is fixed to the casing of the controller.

26. The kit of claim 19, wherein:

the light module comprises a base, the base having a recess defining a light exit window;

the light module further comprises at least one rest defining the position of a printed circuit board relative to the light exit window;

the printed circuit board spans the recess; and the printed circuit board and the base are attached to each other.

* * * * *